United States Patent [19]

Schlichting et al.

[11] Patent Number: 4,810,286

[45] Date of Patent: Mar. 7, 1989

[54] METHOD FOR REDUCING DISSOLVED OXYGEN AND CARBON CONTENTS IN MOLTEN STEEL

[75] Inventors: Mark R. Schlichting, Chesterton; Marian Szatkowski, Dyer, both of Ind.

[73] Assignee: Inland Steel Company, Chicago, Ill.

[21] Appl. No.: 209,863

[22] Filed: Jun. 22, 1988

[51] Int. Cl.[4] ..... C21C 7/10

[52] U.S. Cl. ..... 75/49; 75/59.13

[58] Field of Search ..... 75/49, 59.13

[56] References Cited

U.S. PATENT DOCUMENTS 4,541,862 9/1985 Finkl ..... 75/49

4,545,815 10/1985 Toth ..... 75/49

4,604,137 8/1986 Yamada ..... 75/49

*Primary Examiner*—Peter D. Rosenberg

*Attorney, Agent, or Firm*—Marshall, O'Toole Gerstein, Murray & Bicknell

[57] ABSTRACT

The carbon and dissolved oxygen contents of molten steel are reduced by a vacuum degassing treatment which may employ oxygen blowing. A determination is made of the idealized trajectory or path reflecting the change in carbon content and dissolved oxygen content, between atmospheric pressure and a preselected sub-atmospheric pressure at which the vacuum degassing treatment occurs. The idealized trajectory also reflects the effect of extraneous factors on the carbon content, dissolved oxygen content and temperature of the molten steel during the treatment. A selection is made of the boundaries of the idealized trajectory based upon the permissible limits of carbon content, dissolved oxygen content and temperature at the end of the vacuum degassing treatment. Adjustments are made at the beginning of the treatment and periodically throughout the treatment to maintain all three parameters, carbon content, dissolved oxygen content and temperature, within the boundaries of the idealized trajectory. The adjustments employ procedures extraneous to the vacuum degassing treatment.

14 Claims, 3 Drawing Sheets

METHOD FOR REDUCING DISSOLVED OXYGEN AND CARBON CONTENTS IN MOLTEN STEEL

BACKGROUND OF THE INVENTION

The present invention relates generally to a method for reducing the carbon content of molten steel by the employment of vacuum degassing and more particularly to such a method in which oxygen blowing is also employed. A method of this type is conventionally known as an RH—OB process.

The RH—OB process employs a vertically disposed treatment vessel from the bottom of which extend a pair of tubular members having open lower ends and which function as siphon tubes or snorkels. The treatment vessel is disposed directly above a ladle which contains a bath of molten steel covered with slag and including carbon and dissolved oxygen. The ladle is raised until the lower open ends of the two snorkels extend below the surface of the molten steel. The interior of the treatment vessel is evacuated through an exhaust outlet located near the top of the vessel. The atmospheric pressure on the molten steel in the ladle causes the molten steel and slag cover to rise upwardly through the two snorkels into the interior of the treatment vessel which has been evacuated to a sub-atmospheric pressure. An inert gas, such as argon or nitrogen, is introduced into one snorkel to reduce the density of the molten steel therein, and molten steel in that snorkel rises relative to the molten steel in the other snorkel. The net result is that less dense molten steel enters the treatment vessel through the one snorkel (the inlet snorkel) and denser molten steel exits the treatment vessel through the other snorkel (the exit snorkel).

In this manner molten steel is circulated from the ladle upwardly through the inlet snorkel into the interior of the treatment vessel and then downwardly through the exit snorkel back into the ladle. When the molten steel is in the treatment vessel it undergoes a process which reduces the carbon and dissolved oxygen contents of the molten steel, in a manner to be described below. The introduction of inert gas into the molten steel at the inlet snorkel increases the surface area of steel exposed to the reduced pressure within the treatment vessel, thereby facilitating the treatment.

Continuing the circulation procedure for a period of time results in the entire volume of the molten steel in the ladle being subjected to the treatment. Typically, the total contents of the ladle, usually an entire heat of steel from a basic oxygen furnace (e.g. 200 tonnes of molten steel), is circulated through the treatment vessel in a few minutes or less. The bath of molten steel in the ladle is typically recirculated through the treatment vessel number of times for as long as it takes to reduce the carbon content to the desired level, and the treatment time can be 10–30 minutes, for example.

The molten steel subjected to the treatment described above is non-deoxidized before the treatment begins, i.e. the molten steel contains a substantial quantity of dissolved oxygen which has not been removed by reaction with a solid deoxidizing agent such as aluminum or silicon. The carbon content in molten steel containing dissolved oxygen is reduced when the molten steel is subjected to a vacuum degassing operation. More particularly, the dissolved oxygen in the molten steel reacts with the carbon to form carbon monoxide which leaves the molten steel in the treatment vessel and is exhausted therefrom. This is known as natural decarburization.

Steel with very low carbon contents (i.e. 0.002 wt.%) can be produced under these conditions.

The reaction between carbon and oxygen to form carbon monoxide (CO) is an equilibrium reaction which can move in either direction ($C+O \rightleftarrows CO$). The direction in which the reaction occurs is related to the partial pressure of carbon monoxide in the atmosphere above the molten steel in the treatment vessel. Initially, the molten steel is saturated with dissolved oxygen so that lowering the partial pressure of carbon monoxide by exhausting CO from the vessel drives the reaction to produce carbon monoxide. Because the carbon monoxide is continuously withdrawn, thereby maintaining a relatively low partial pressure of CO within the treatment vessel (e.g. 200 Torr. or less), the reaction is continuously driven in a direction to form carbon monoxide, and this removes both dissolved oxygen and carbon from the molten steel. The net result is to reduce substantially both the carbon content and the dissolved oxygen content of the molten steel.

Generally, the lower the partial pressure of CO, the lower the carbon content when equilibrium is attained.

The process described above is known as the RH process. A refinement of this process is known as the RH—OB process in which the treatment vessel is equipped with oxygen tuyeres or blowers in the sides of the vessel, at the lower part thereof. Oxygen can be blown through these tuyeres into the molten steel in the treatment vessel, and this provides several potential benefits.

More particularly, the oxygen can be utilized to accelerate decarburization, and this is known as forced decarburization. Forced decarburization provides faster processing of the steel in the vacuum degassing vessel, which is desirable in that it maximizes utilization of downstream casting equipment, such as a continuous caster which can be scheduled to continuously cast, without interruption, the molten steel from the degassing vessel. In addition, the untreated molten steel can be tapped from the basic oxygen furnace at a significantly higher carbon level and a significantly lower dissolved oxygen level, than when the molten steel from the basic oxygen furnace is to be subjected to a vacuum degassing treatment not employing oxygen blowing, and that is desirable. Oxygen blowing increases the amount of carbon which can be removed from the molten steel by vacuum degassing at a given sub-atmospheric pressure. Oxygen blowing also reduces the time period required to reduce carbon to the desired level, at a given partial pressure.

Moreover, in a treatment vessel equipped to provide oxygen blowing, the molten steel undergoing treatment can be reheated employing a process called aluminum reheating in which aluminum is added to the molten steel and oxygen is blown through the tuyeres causing a reaction, between the aluminum and the oxygen, which is exothermic and produces heat. Aluminum reheating is disadvantageous in some respects because, aluminum being relatively expensive, its employment as a heat source is an expensive way to obtain energy. In addition, the aluminum oxide formed by the reaction during aluminum reheating must be flushed from the molten steel into the slag cover on the molten steel, and this requires additional recirculation time which in turn prolongs the process. Oxygen blowing itself has a drawback in that it has an adverse affect on refractory life in the treatment vessel.

The temperature at which the treatment is conducted depends upon the temperature at which the steel is to be cast following treatment. The casting temperature is usually about 60° C. higher than the solidus temperature of the steel. It is desirable to start the treatment at a temperature no lower than the casting temperature.

In conventional practice, if the molten steel arrives at the treatment vessel with a temperature which is too low or with a carbon content which is outside the range of initial carbon content for which the treatment has been designed, a pretreatment is performed to bring the starting temperature and the starting carbon content into the ranges desired. The carbon content can be reduced or increased during the pre-treatment by oxygen blowing or coke addition respectively. The temperature can be raised by aluminum reheating.

Alloy additions to the molten steel are made in the treatment vessel, after the pressure has been reduced and recirculation is occurring.

Following the decarburization part of the treatment, the remaining dissolved oxygen content is eliminated by adding a solid deoxidizing agent such as aluminum. This, of course, forms aluminum oxide, and substantial amounts of aluminum oxide inclusions in the finished steel product are undesirable. Prolonged additional recirculation of the molten steel to flush the aluminum oxide into the slag is undesirable because it delays casting resulting in down time for the casting equipment.

At the conclusion of the treatment, after deoxidation with aluminum to remove the residual dissolved oxygen, and after additional recirculation to flush the aluminum oxide inclusions into the slag, the vessel is repressurized, and all the molten steel descends into the ladle. The ladle is then moved to a casting station at which the molten steel is withdrawn from the ladle into either ingot molds or into a continuous caster.

The time period for the treatment is usually set by scheduling considerations at a casting station downstream of the vacuum degasser. Accordingly, an operating vacuum (partial pressure) or a combination of operating vacuum and oxygen blowing (if the latter is available) is selected which will reduce the carbon content to the desired level in the period of time available.

In conventional practice, measurements are made of the temperature and carbon and dissolved oxygen contents of the molten steel leaving the basic oxygen furnace. Calculations are made of the predicted end points for carbon and temperature after vacuum degassing, based upon the processing conditions to be employed and upon certain extraneous factors such as required alloying additions. The calculations for carbon and temperature treat the changes in carbon and temperature as functions of time, and they are made independently of each other. A similar independent calculation is made of the predicted dissolved oxygen end point. If the predicted end points for carbon and temperature don't come within permissible limits of the aim end points for carbon and temperature, processing adjustments are made, either during the pre-treatment or during the treatment itself, to bring the predicted end points closer to the aim end points.

However, when following conventional practice, the actual results obtained at the end of decarburization do not conform sufficiently closely to the aim. There are substantial differences between (a) actual carbon and dissolved oxygen contents and (b) predicted carbon and dissolved oxygen contents, both in average relative error and in standard deviation of the relative error, over a number of heats. In addition, the end temperature cannot be accurately predicted.

In conventional practice, the calculations employed to predict end points do not include a number of important factors such as the effect of changes in pressure on the decarburization rate and on changes in the dissolved oxygen content. The carbon/oxygen equilibria, at the different pressures and temperatures occuring during the treatment, are not taken into account. Although conventional practice includes oxygen return from the slag to the molten steel as a factor in calculating the amount of decarburization, conventional practice does not include the effect of reduced pressure on oxygen return from the slag. Conventional practice does not employ the carbon/oxygen equilibrium curve in predicting carbon and dissolved oxygen end points, or the effect of oxygen-consuming additions (such as a manganese alloy) on the dissolved oxygen content. The calculations for carbon, dissolved oxygen and temperature are not solved simultaneously, and the effect of dissolved oxygen content on the process is largely ignored. Dissolved oxygen is not adjusted or otherwise addressed as a process controlling parameter in conventional practice which also largely ignores the effect of carbon, dissolved oxygen and temperature on each other when controlling or adjusting carbon or temperature.

SUMMARY OF THE INVENTION

When employing a method in accordance with the present invention, the relative error between (1) the aim carbon and predicted dissolved oxygen contents and (2) the actual carbon and dissolved oxygen contents at the conclusion of the treatment, is reduced substantially, and this is so for both the average relative error and the standard deviation of the relative error.

This improvement is accomplished by determining, with greater accuracy, the projected change in both carbon content and dissolved oxygen content in the molten steel from the beginning of the treatment, at atmospheric pressure, to the end of the treatment at the preselected sub-atmospheric pressure. More particularly, a determination is made of the idealized trajectory or continuous change in carbon content, oxygen content and temperature occurring during the treatment, from atmospheric pressure to the preselected sub-atmospheric pressure. This enables one to select the optimum or idealized starting point in the treatment, for dissolved oxygen content, carbon content and temperature, at atmospheric pressure. In making such a determination of the idealized trajectory, particular attention is paid to all the factors which can influence changes in carbon content, dissolved oxygen content and temperature. These factors include all those noted above as ignored or unaddressed in conventional practice.

After making the determination described above, the actual carbon content, dissolved oxygen content and temperature of the molten steel as received from the basic oxygen furnace are measured and compared with the optimum starting point, and adjustments are made to bring the actual values of carbon content, dissolved oxygen content and temperature to within an acceptable range of the optimum starting point. Thereafter, while the treatment is in progress, the actual temperature and dissolved oxygen content of the molten steel are measured periodically, and the corresponding carbon content is determined. These values are compared with the values for carbon content, dissolved oxygen content and temperature on the idealized trajectory. If any of the actual values are outside the permissible range for that value, when compared to the value thereof on the idealized trajectory, adjustments are made to conform each deviant actual value more closely to the idealized value on the trajectory.

By periodically monitoring and adjusting the actual dissolved oxygen content, temperature and carbon content, during the course of the treatment, one will obtain, at the end of the treatment, a carbon content, dissolved oxygen content and temperature much closer to the aim or predicted values thereof than was obtained by following the prior art procedures.

Other features and advantages are inherent in the method claimed and disclosed or will become apparent to those skilled in the art from the following detailed description in conjunction with the accompanying diagrammatic drawing.

DETAILED DESCRIPTION

Figure 1:
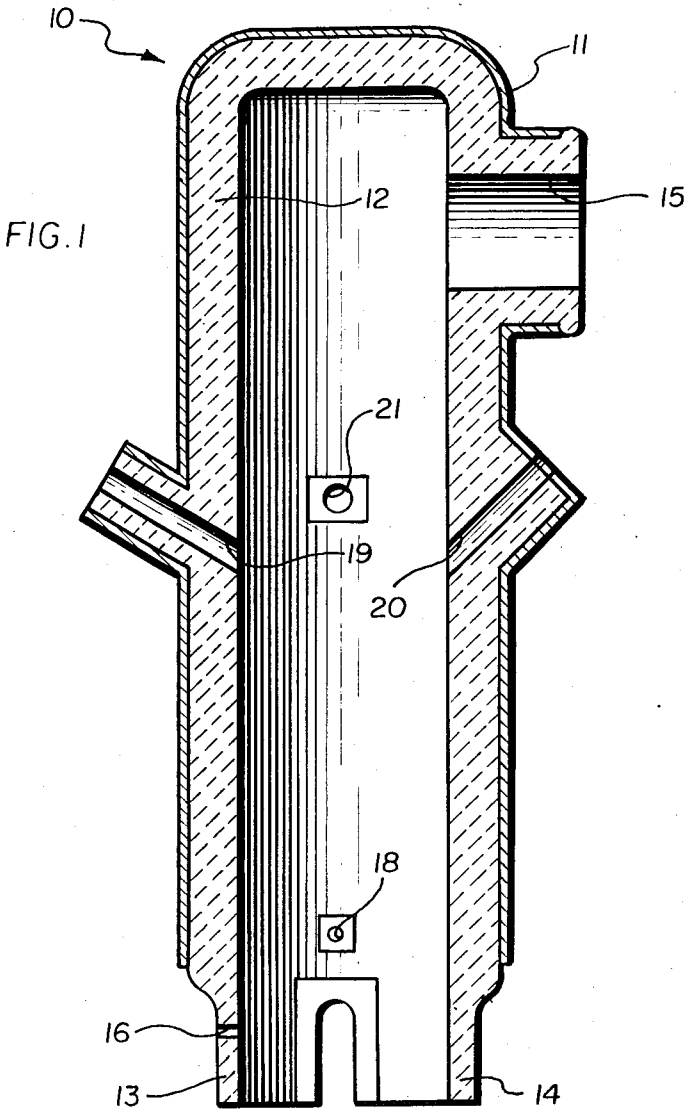
FIG. 1 is a diagrammatic, vertical sectional veew of a RH—OB apparatus which may be employed to perform a method in accordance with the present invention.

Referring initially to FIG. 1, indicated generally at 10 is an RH—OB vessel for conducting a vacuum degassing treatment to reduce the carbon content and dissolved oxygen content of molten steel. Vessel 10 includes a steel exterior shell 11 and a refractory interior lining 12. Extending downwardly at the bottom of the vessel is a tubular inlet snorkel or leg 13 and a tubular outlet snorkel or leg 14, both legs 13 and 14 having open lower ends through which molten steel circulates in and out of vessel 10. Located near the top of vessel 10 is an exhaust outlet 15, and located at inlet snorkel 13 is a gas inlet 16. Disposed near the bottom of vessel 10, above legs 13, 14 are oxygen blowing tuyeres, one of which is shown at 18. Located near the mid-section of the vessel are an alloy or solid addition inlet 19 and a vessel preheat gas port 20. Immediately above inlet 19 and port 20 is a port 21 through which an electrode rod heater may be inserted to maintain the vessel temperature between heats.

When a treatment is to be conducted, a ladle (not shown) containing a bath of molten steel covered with slag is located below vessel 10 and raised upwardly until snorkels 13 and 14 extend downwardly below the surface of the bath into the molten steel. The interior of vessel 10 is then evacuated through exhaust outlet 15. As a result, the atmospheric pressure on the bath of molten steel in the ladle forces the molten steel and covering slag upwardly through snorkels 13 and 14, into the interior of vessel 10, to a height above oxygen blowing tuyere 18. Typically, tuyere 18 is located slightly below the surface of the molten steel in vessel 10.

An inert gas, such as argon or nitrogen, is introduced through gas inlet 16 into snorkel 13. This reduces the density of the molten steel in leg 13, compared to the density of the molten steel in leg 14, and the net result is a circulation of the molten steel from the bath in the ladle upwardly through snorkel 13 into the interior of vessel 10 and then downwardly through snorkel 14 out of vessel 10 and back into the bath of molten steel in the ladle. This circulation continues for as long as gas is introduced through gas inlet 16.

As the molten steel circulates through vessel 10, it undergoes a vacuum degassing treament which reduces the carbon content and dissolved oxygen content in the molten steel. The degassing treatment is continued until the carbon content has been reduced to the desired amount.

The lower the sub-atmospheric pressure in vessel 10 (i.e. the greater the vacuum), the lower the final carbon content which can be obtained. However, the lower the carbon content, the longer the treatment time if carbon content is to be reduced solely by means of natural decarburization. Carbon content can also be reduced by introducing oxygen through oxygen blowing tuyere 18. However, this increases the residual dissolved oxygen content remaining in the molten steel at the end of the treatment.

When the carbon content has been reduced to the desired amount, there is still some dissolved oxygen in the molten steel, and this is undesirable. The residual dissolved oxygen content is removed by adding aluminum to the molten steel, e.g. through alloy addition inlet 19. The aluminum reacts with the residual dissolved oxygen in the molten steel to form alminum oxide inclusions. Circulation is continued after the aluminum addition, and the resulting stirring action flushes the aluminum oxide inclusions into the slag cover on the molten steel. The slag cover was carried over from the slag in the ladle, and that slag in turn was carried over from the basic oxygen furnace in which the molten steel was produced; or the ladle slag may have been wholly or partially added to the molten steel after the molten steel was in the ladle.

After a sufficient amount of circulation has occurred to flush the aluminum oxide inclusions into the slag cover, the interior of vessel 10 is repressurized, causing the molten steel to descend back into the ladle which is then lowered, resulting in the withdrawal of snorkels 13, 14 from beneath the surface of the bath. The ladle is then removed to a casting station where the fully treated molten steel is withdrawn from the ladle into ingot molds or into the tundish of a continuous casting apparatus.

While the molten steel is undergoing a vacuum degassing treatment in vessel 10, alloying ingredients such as manganese, or other solid addition ingredients, may be introduced into vessel 10 through inlet 19, and such additions occur while the steel is still being circulated from the ladle into the interior of vessel 10 and then back into the ladle.

The chemical reaction involved in the decarburization of the steel is as follows:

$$C+O \rightleftharpoons CO$$

The foregoing formula is an equilibrium reaction which can proceed in either direction depending upon the partial pressure of carbon monoxide in the atmosphere above the molten steel. This is reflected in FIG. 2 which shows, at 34 and 32, the respective carbon/free (dissolved) oxygen equilibrium curves at atmospheric pressure (760 Torr.) and at a partial vacuum (e.g. 200 Torr.).

The equation for the carbon/dissolved oxygen equilibrium curve can be expressed as follows:

$$K=[C\% \times 0\%]/PCO,$$

where

C%=carbon content, wt. %

0%=dissolved oxygen content, wt. %

PCO=partial pressure of CO, Torr.

K is a constant, the log of which can be expressed as follows:

$$\log K=-2.07-1168/T,$$

where T=steel temperature in degrees Kelvin (K°).

From the foregoing formulas it can be seen that both the carbon content and the dissolved oxygen content are directly proportional to the partial pressure of carbon monoxide above the molten steel and inversely proportional to the content of each other in the molten steel.

Set forth below is a description of the procedures and controls which are exercised when a vacuum degassing treatment is conducted in accordance with the method of the present invention.

The initial starting point in determining the procedures and controls to be exercised is the aim carbon content which, in a vacuum degassing operation, may be somewhere between 0.002 and 0.04 wt. %, for example. The next consideration is to select a partial pressure or vacuum level at which a relatively low dissolved oxygen content exists in equilibrium with the aim carbon content. This is illustrated in FIG. 2.

Figure 2:
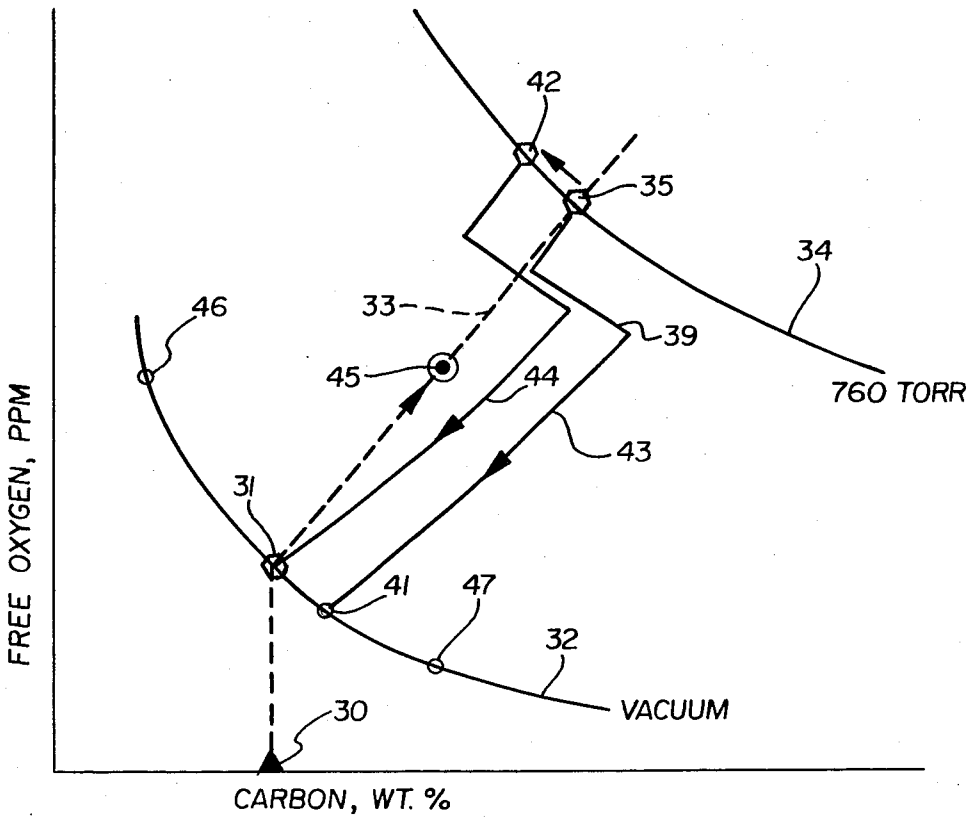
FIG. 2 is a graph illustrating both a theoretical and an adjusted idealized trajectory for carbon content and free (dissolved) oxygen content occuring during the vacuum degassing treatment.

The aim carbon content is shown at 30 in FIG. 2. A vertical line is drawn from point 30 in an upward direction (the direction of increasing free oxygen content) until there is an intersection at 31 with a carbon/dissolved oxygen equilibrium curve 32, at the nose of the curve. The partial pressure reflected by that particular equilibrium curve at which the vertical line from the aim carbon content intersects the curve at its nose is considered the most desirable partial pressure for performing the degassing treatment. Equilibrium curves at other partial pressures, where the vertical line from the aim carbon content would intersect the curve at a point above or below the nose of the curve, reflect less desirable partial pressures than one where the vertical line from the aim carbon content intersects the equilibrium curve at its nose. The sub-atmospheric pressure selected for conducting the treatment is based upon practical experience, and reflects the pressure required to get to the aim carbon content in a reasonable length of time without too large a dissolved oxygen content at the end of the treatment. Examples of such pressures are in the range 0.5–200 Torr. Generally, the lower the aim carbon content, the lower the pressure.

The oxygen content at point 31 on curve 32 can be determined from a graph like FIG. 2 or from the equation for equilibrium curve 32, described above, as the carbon content, the partial pressure of carbon monoxide, and the steel temperature are all known. The steel temperature is typically 60° C. above the solidus temperature of the steel.

The next step in the procedure is to determine the theoretical idealized starting values for the carbon content and the dissolved oxygen content at atmospheric pressure. These values are determined by drawing a line 33 at a slope of 1.33 from equilibrium curve 32 to the equilibrium curve 34 for carbon/dissolved oxygen at atmospheric pressure (760 Torr.). A slope of 1.33 is the slope of an ideal trajectory assuming a stoichiometric reaction between carbon and oxygen to form CO, and assuming no oxygen return from the slag on the molten steel and no addition of alloys containing carbon or consuming oxygen. A slope of 1.33 is a 60 degree slope, and this reflects the fact that one atom of oxygen combines with one atom of carbon to produce carbon monoxide, adjusted for the respective atomic weights of carbon and oxygen.

The intersection of line 33 with equilibrium curve 34 is indicated at 35. The carbon content and free oxygen content at theoretical idealized starting point 35 can be determined from a graph like FIG. 2 or from the equation for curve 34, described above.

Figure 3:
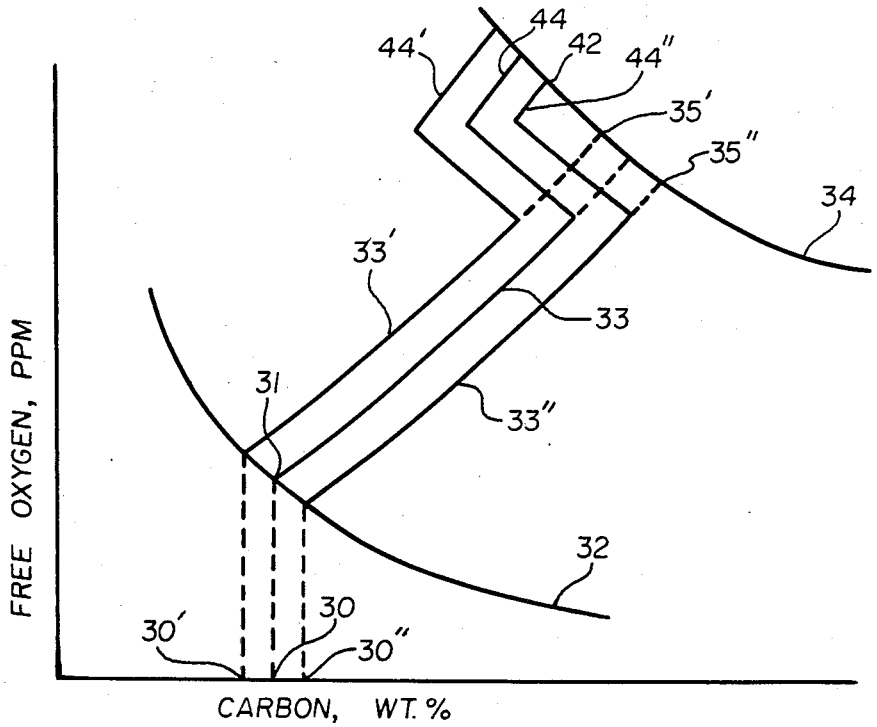
FIG. 3 is a graph similar to FIG. 2, with permissible ranges of carbon and free oxygen applied to the trajectory.

The next step in the procedure is to plot the permissible limits for the carbon content on the graph. This is shown in FIG. 3 where the permissible minimum and maximum limits for the carbon content are indicated at 30′ and 30″ respectively. The limits for the carbon content are then projected vertically on the graph until they intersect equilibrium curve 32 and from there the limits are projected at a slope parallel to the slope for theoretical idealized trajectory 33 until they intersect equilibrium curve 34 at 35′ and 35″ respectively. In FIG. 3 the lines 33′ and 33″ reflect the limits on the carbon content and the dissolved oxygen content as the degassing treatment proceeds between atmospheric pressure and the preselected sub-atmospheric pressure, for a reaction in which it is assumed that there is no oxygen return from the slag and there is no addition of carbon-containing or oxygen consuming alloying ingredients.

Figure 4:
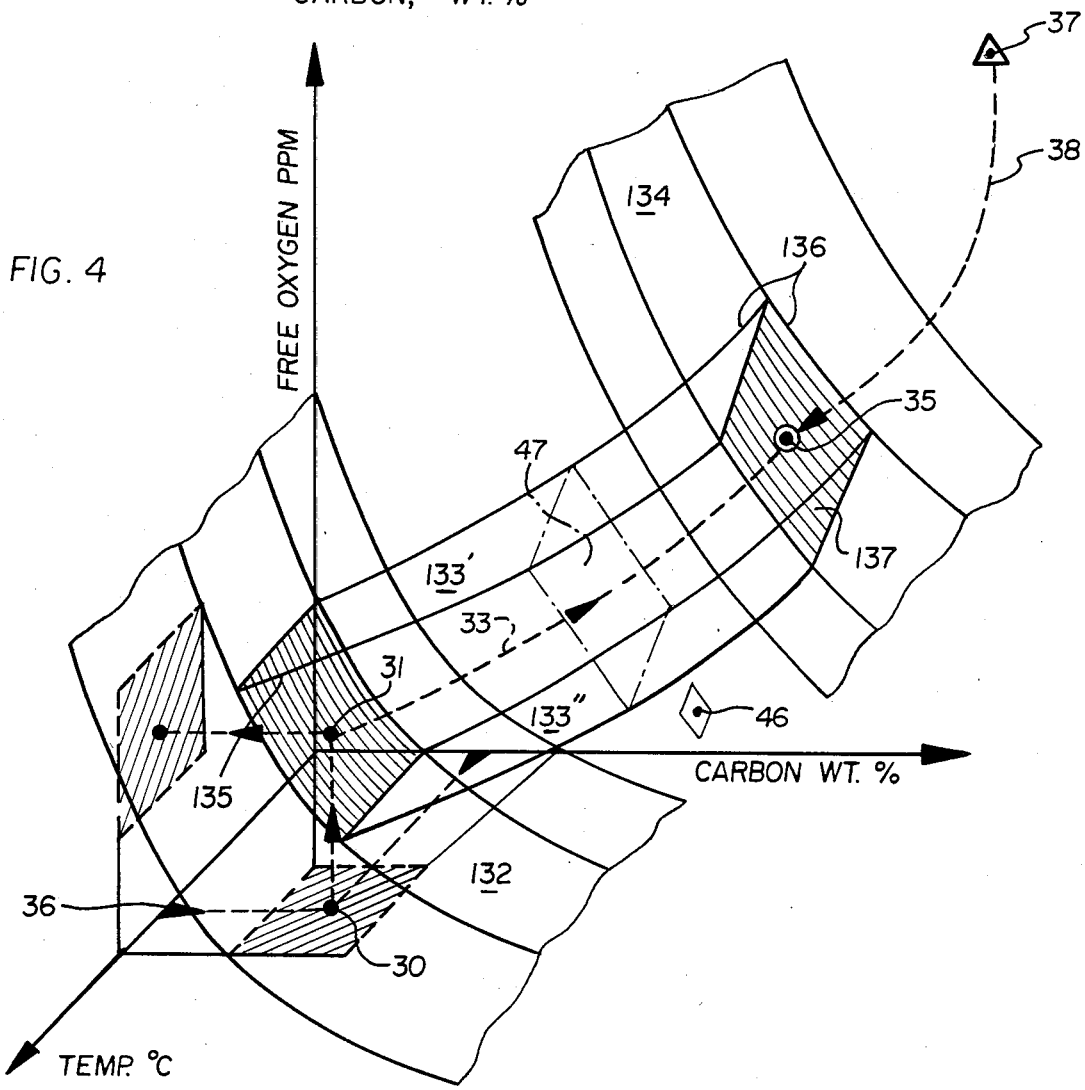
FIG. 4 is a three dimensional plot in which permissible temperature ranges are applied to the theoretical idealized trajectory.

The next step in the procedure is to incorporate the permissible temperature range into the graphic display of the permissible limits on carbon and oxygen, and this is illustrated in FIG. 4. The aim temperature at the conclusion of the process is usually 50°–60° C. above the solidus temperature for the steel and the permissible variation is typically 5° C. on either side. For example if the solidus is 1550° C. (1823° K.) the temperature at which the process is conducted would be 1823° K. plus e.g. 55°–65° K., or 1878°–1888° K. (1605°–1615° C.). In FIG. 4, point 36 indicates the preselected end temperature for the process, e.g. 60° C. above the solidus temperature.

In FIG. 4 the equilibrium curve for the sub-atmospheric pressure at which the process is conducted is represented by the surface 132 (corresponding to equilibrium curve 32 in FIG. 3). Similarly the equilibrium curve at atmospheric pressure is represented by the surface 134 in FIG. 4 (corresponding to equilibrium curve 34 in FIG. 3). One limit on the carbon and dissolved oxygen contents is represented by the surface 133′ in FIG. 4 (corresponding to lin 33′ in FIG. 3), and the other limit on carbon and dissolved oxygen is represented by surface 133″ in FIG. 4 (corresponding to line 33″ in FIG. 3). The upper and lower temperature limits are represented by the surfaces 135, 136 respectively in FIG. 4.

In summary, in FIG. 4, the surfaces 133', 133", 135 and 136 define the boundaries for the trajectory to be followed by the dissolved oxygen content and the carbon content when these contents decrease with a decrease in pressure between atmospheric pressure (surface 134) and the preselected sub-atmospheric pressure (surface 132). As noted above, this is a theoretical idealized trajectory which assumes no change in the carbon or dissolved oxygen contents from extraneous sources such as the slag or alloying additions or the like and which also assumes no change in the temperature from such sources.

The idealized temperature boundaries shown in FIG. 4 assume no substantial temperature drop during the process. In actual practice, there will usually always be an intrinsic temperature drop (e.g. 20°–25° C.) during the process so that the starting temperature would have to be that much higher than the aim finishing temperature (which is 60° C. above solidus) to accommodate the temperature drop. The factors contributing to the temperature drop and their effect on the trajectory will be discussed below. For now, suffice it to say that the trajectory would be skewed in the direction of increasing temperature from surface 132 to surface 134, in a graphic representation like FIG. 4.

After the idealized trajectory and its carbon, dissolved oxygen and temperature limits have been defined, as illustrated in the three dimensional plot in FIG. 4, the next step in the procedure is to measure the carbon content, dissolved oxygen content and temperature of the molten steel from the basic oxygen furnace. A point reflecting these measurements is indicated at 37 in FIG. 4, for illustrative purposes. If any of these parameters (carbon, dissolved oxygen or temperature) do not fall within the prescribed limits for the idealized trajectory at atmospheric pressure (the intersection of the three-dimensional trajectory 133', 133", 135, 136 with surface 134 in FIG. 4), a pre-treatment is performed to bring all of these parameters into conformance with the theoretical idealized trajectory and its upper boundary at atmospheric pressure. This is the shaded area 137 on surface 134 in FIG. 4. Optimally, the parameters are adjusted from point 37 to point 35 on shaded area 137. From a practical standpoint, as long as all three parameters define a point within shaded area 137, that should suffice.

Figure 5:
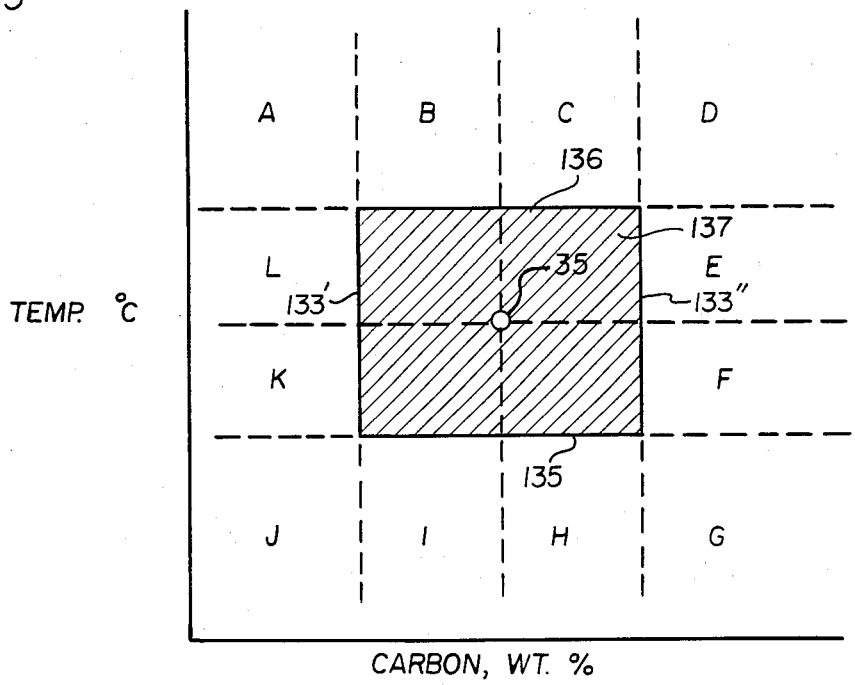
FIG. 5 is a projection of a section, through the three dimensional plot of FIG. 4, on a two dimensional plane defined by a temperature coordinate and a carbon content coordinate.
Figure 6:
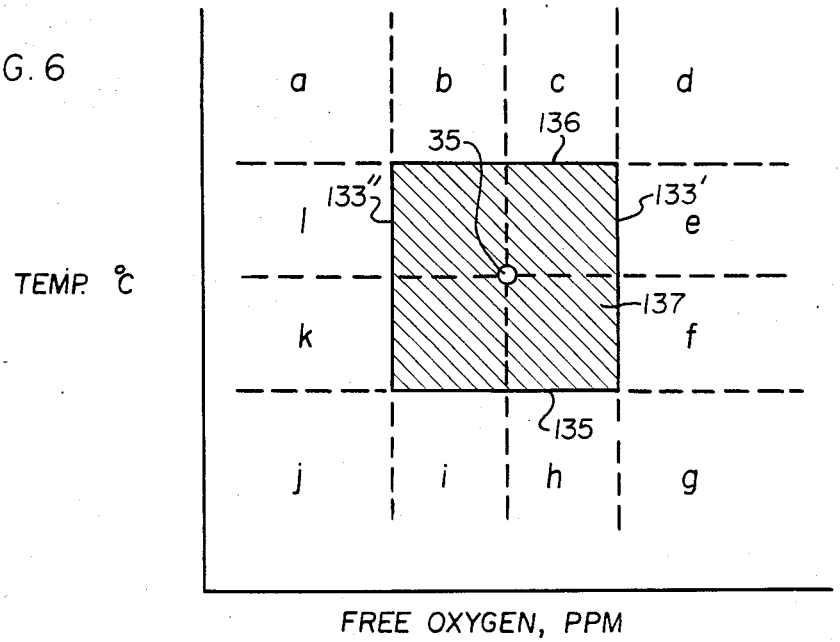
FIG. 6 is a projection of the section projected in FIG. 5, but on a plane defined by the temperature coordinate and a free oxygen coordinate.

The pre-treatment may be better understood by reference to FIGS. 5 and 6. FIG. 5 is a projection of shaded area 137 on a plane defined by the temperature coordinate and the carbon content coordinate. FIG. 6 is a projection of shaded area 137 on a plane defined by the temperature coordinate and the free oxygen content coordinate. In FIG. 5 the permissible temperature range lies between lines 135 and 136, and the permissible carbon content lies between lines 133' and 133". In FIG. 6, the permissible temperature again lies between lines 135 and 136 while the permissible oxygen content lies between lines 133" and 133'. In FIG. 5, the area outside of shaded area 137 is divided into sections from A to L. In FIG. 6, the area outside shaded area 137 is divided into sections a-l. Typical examples of pretreatment adjustments will now be described.

Referring to FIGS. 5 and 6, if the measured temperature, carbon content and dissolved oxygen content of the molten steel from the basic oxygen furnace fall within section L in FIG. 5 and section e in FIG. 6, this means that the temperature is within the permissible range, but the carbon content is too low and the free oxygen content is too high. The preferred correctional procedure in such a case would be to add coke.

If the measured parameters for the molten steel fall within section F in FIG. 5 and section k in FIG. 6, this means that the carbon content is too high, the free oxygen content is too low and the temperature is within the permissible limits. The preferred correctional procedure in such a case would be forced decarburization accomplished by blowing oxygen through tuyere 18.

If the measured parameters for the molten steel from the BOF fall within section H in FIG. 5 and section h in FIG. 6, this means that the temperature is too low while the carbon and oxygen contents are within the permissible limits. In such a case aluminum reheating would be employed as the correctional procedure.

The pre-treatment may employ any of the usual procedures for increasing or decreasing oxygen, carbon or bath temperature. For example, the oxygen content can be increased, if necessary, by blowing oxygen through tuyere 18. The oxygen content can be decreased by adding aluminum or by adding coke. The temperature can be decreased by adding scrap, and the temperature can be increased by blowing oxygen and adding aluminum. The carbon content can be increased by adding coke, and may be increased to a lesser extent if scrap has been added to reduce the temperature of the molten steel. The carbon content can be reduced by blowing oxygen.

The pre-treatment is conducted in vessel 10 which has been initially partially evacuated (e.g. to 250–280 Torr.), enough to raise the molten steel from the ladle up into the interior of vessel 10. Accordingly, the pressure in vessel 10 is not truly at atmospheric pressure when the pre-treatment is conducted. However, the difference between atmospheric pressure and the initial sub-atmospheric pressure necessary to elevate the molten steel into the interior of vessel 10 is relatively small enough so that a pre-treatment aimed at bringing the parameters toward point 35 on shaded surface 137 would not result in a starting point outside the idealized three dimensional trajectory at the initial sub-atmospheric pressure at which the pretreatment is conducted. Optionally, in making the pre-treatment adjustment, one may aim for a point on the idealized trajectory slightly further down the trajectory than its upper end boundary 137, and this would accommodate the initial sub-atmospheric pressure at which the pre-treatment is performed and the slight amount of decarburization which may have already occurred due to the initial decrease in pressure from atmospheric. The pretreatment is performed as soon as the molten steel is circulating within the interior of vessel 10.

Once the temperature, carbon content and dissolved oxygen content have been adjusted so that they all lie within the boundaries of the idealized trajectory, the pressure within the interior of vessel 10 is reduced to the sub-atmospheric pressure at which the treatment is to be conducted, indicated at surface 132 in FIG. 4, and the rest of the treatment is performed. Ideally, during the treatment, all three parameters stay within the boundaries of the idealized trajectory illustrated in three dimensions in FIG. 4. Nevertheless, there can be some straying of one or more parameters outside the boundaries of the idealized trajectory. Therefore, the parameters are periodically monitored or measured or otherwise determined, and if any of these parameters are outside the boundaries of the idealized three dimensional trajectory illustrated in FIG. 4, adjustments are made, similar to those described above in connection with the pre-treatment, to bring whatever parameter lies outside the boundaries of the idealized trajectory back within those boundaries. These adjustments can be graphically described with reference to FIG. 4.

More particularly, the three parameters, for a given instance of periodic monitoring, define a point on the three dimensional plot of FIG. 4. There is a plane which includes this point and which is also perpendicular to and intersects idealized trajectory line 33. There is an area 47 of this intersecting plane which is defined by the boundaries 133', 133'', 135, 136 of the idealized trajectory. If the point, defined by the three parameters at the given instance of periodic monitoring, lies outside the boundaries of the idealized trajectory (i.e. outside planar area 47), e.g. at 46, adjustments are made to bring that point within planar area 47 or within a parallel planar area inside the boundaries of the idealized trajectory but closer to end surface 132.

An adjustment affecting any one of the three parameters can affect the other two parameters. Adjustments affecting one, two or three of the parameters can be made simultaneously. The number of adjustments and the particular adjustments selected are the ones that will best suit the desired end results for all three parameters. One should not, of course, make diametrically opposed adjustments (e.g. one should avoid adding aluminum to increase the temperature and simultaneously adding coke which will decrease the temperature or adding oxygen to decrease carbon and then subsequently adding coke to increase carbon).

Procedures are available for measuring the temperature and the oxygen content without substantial delay. There is, however, a delay of a few minutes between the time a sample is taken from the molten steel and the time at which the carbon content thereof is determined by analysis. However, because the oxygen content, the temperature and the pressure will be known, the carbon content can be estimated closely enough by calculation, employing the equilibrium curve equation described above. If the analyzed carbon content, which will be obtained as a check a few minutes after the calculation has been made, differs significantly from the calculated carbon content, another adjustment can be made.

In a typical treatment, it may take several minutes for the pressure within the interior of vessel 10 to drop from atmospheric pressure to the selected sub-atmospheric pressure at which the treatment is intended to be conducted. Typically, in a treatment which lasts about 25–30 minutes, for example, about 60% of the treatment occurs at the final sub-atmospheric pressure, with the balance being conducted at decreasing pressures between atmospheric pressure and the final sub-atmospheric pressure. The actual pressure within the interior of vessel 10 can be monitored, and the actual pressure can be taken into account when making calculations for determining the estimated carbon content. The reason it takes so much time to conduct the treatment at the final sub-atmospheric pressure is because there is a substantial quantity of molten steel to be treated (e.g. over 200 tonnes).

An advantage in keeping all three parameters (carbon, dissolved oxygen and temperature) within the boundaries of the idealized trajectory throughout the treatment is that, at the end of the treatment, not only is the carbon content at the desired value but also, the dissolved oxygen content and the temperature are at the desired optimum values. The desired oxygen content is relatively low and, as a result, the amount of aluminum necessary to deoxidize the molten steel is reduced, compared to that required for a higher oxygen content; and this is desirable because less time is required to flush the resulting aluminum oxide inclusions out of the molten steel and/or there are fewer such inclusions remaining in the steel when the latter is solidified. The advantage of maintaining the temperature at an optimum value is that this facilitates casting after the treatment without further temperature adjustment and its attendant disadvantages.

More particularly, if the temperature at the end of the treatment is too high, one must add scrap to cool the steel quickly, and that could increase the carbon content. The steel cannot be allowed to merely cool in air because that takes too long, and it delays production activities at the casting station which would have to remain idle until the molten steel was cooled to the desired casting temperature.

If the temperature at the end of the treatment is too low, aluminum reheating would have to be employed, and this means adding both aluminum and oxygen which would be undesirable because it would increase the amount of aluminum oxide inclusions in the molten steel, which in turn would increase the time required to flush the inclusions out of the molten steel into the slag layer, or else it would result in too large an inclusion content in the steel after it was solidified.

Aluminum reheating at an intermediate stage of the treatment, several minutes before the end, is not undesirable because there is sufficient time remaining to flush the aluminum oxide inclusions out of the molten steel into the slag, employing the recirculation which will be occuring as part of the normal decarburization procedure. An intentional delay, for prolonged recirculation after the carbon content has been reduced to the desired low level, is usually not required. However, the closer one gets to the end of the treatment, the less desirable it is to perform aluminum reheating because of the greater likelihood that prolonged recirculation will be required.

The treatment time depends upon the aim carbon content. Normally, the lower the aim carbon content, the longer the treatment time. Treatment times typically vary between about 10 and about 32 minutes, for example. The treatment time can be reduced by employing forced decarburization during the treatment, i.e. blowing oxygen into the molten steel through tuyere 18. This expedient may be employed to the extent it does not cause any of the parameters (carbon, dissolved oxygen and temperature) to stray substantially outside the boundaries of the idealized trajectory. Having the ability to remove carbon by both natural decarburization and oxygen blowing (as in the RH—OB process) imparts substantial flexibility to the processing procedures available.

The carbon/oxygen equilibrium curves employed in the procedures of the present invention are those for molten steel at a temperature within the temperature limits selected for use in accordance with the present invention, namely 60° C. above the solidus temperature ±5° C. Variations within these temperature limits do not have any substantial affect on the equilibrium curve.

The above discussion relates to a theoretical idealized trajectory for the carbon content, dissolved oxygen content and temperature in a treatment in which it was assumed that there were no changes in these three parameters due to extraneous factors such as slag effects or alloy additions and no intrinsic temperature change. As a practical matter, there are usually always slag covers on the molten steel bath in the treatment vessel and there are usually always alloy additions to the molten steel as it undergoes treatment in the vessel. An alloying addition, such as manganese, has the effect of increasing the carbon content and decreasing the dissolved oxygen content. In addition, a decrease in the dissolved oxygen content of the molten steel, at a given pressure, can result in an increased return of oxygen from the slag into the molten steel. The temperature of the steel is also affected by the addition of solid alloying agents, such as manganese, the melting of which reduces the temperature of the steel.

The effect of these practical factors on the theoretical idealized trajectory is illustrated graphically in FIG. 2 where line 33 reflects the theoretical idealized trajectory and line 43 reflects the shape of the real trajectory one would find if one continuously measured the carbon and dissolved oxygen contents of the molten steel during a treatment in which the steel was covered with slag and manganese was added. Both trajectories start at point 35 on atmospheric pressure equilibrium curve 34 The abrupt shift in real trajectory 43, at 39, reflects the affect of a manganese addition on the carbon and dissolved oxygen contents. Real trajectory 43 terminates at its intersction 41 with sub-atmospheric pressure equilibrium curve 32, and point 41 is usually displaced from the aim end point 31 on which idealized trajectory 33 was based. Displaced end point 41 provides a higher carbon content then desired.

Real trajectory 43 can be determined, within a reasonable approximation, by mathematical calculations which take into account the following factors: the change in carbon content due to the equilibrium reaction with dissolved oxygen in the steel; the effect of the sub-atmospheric pressure on the decarburization rate; the change in carbon content due to carbon-containing alloying additions; the change in dissolved oxygen content due to the aforementioned equilibrium reaction with the carbon in the steel; the change in dissolved oxygen content due to oxygen return from the slag; the effect of sub-atmospheric pressure on oxygen return from the slag; the dissolved oxygen consumed by alloying additions (e.g. manganese addition); the effect of temperature on oxygen equilibrium in the slag; the change in temperature due to the cooling effect of alloying or other solid additions; the change in temperature due to the heating effect of aluminum reheating or other heating factors; the change in temeerature due to the temperature difference between the molten steel and the treatment vessel; and such other factors, in a given treatment, as may suggest themselves to process metallurgists skilled in the art of processing molten steel.

The foregoing list of factors can be expressed mathematically in three differential equations, one for each of the three parameters: carbon, dissolved oxygen and temperature. These equations should be within the skill of a process metallurgist experienced in the processing of molten steel, given the above information. An example thereof is set forth below.

$$dC = -C \times \text{Alpha} \times dt + dC\ (\text{alloys}) \qquad \text{Equation (1)}$$

where:

Alpha=t (C, O, partial pressure of CO)

C=carbon content at a given time in the treatment dC (alloys)=carbon increase from ferro-alloy addition.

In this model, the alloy addition time is assumed to be negligible compared to the treatment time so that dC (alloys) $=\Delta C$ (alloys), i.e. the increase in carbon content from the ferro-alloy additions is assumed to be essentially instantaneous at the time of addition. Although this is a simplification, it is close enough for practical purposes.

Coefficient Alpha reflects the rate of natural decarburization in the molten steel due to the carbon/oxygen equilibrium reaction and is based upon the concentration of carbon and oxygen atoms in the steel and upon the partial pressure of the CO, at a given point in the treatment, without extraneous factors. Coefficient Alpha expresses how far away the carbon and dissolved oxygen contents are from the equilibrium curve for the sub-atmospheric treatment pressure at a given point in the treatment.

More particularly with respect to coefficient Alpha, referring to FIG. 2, and assuming the process is at a point 45 on theoretical idealized trajectory 33, the distance between point 45 and aim point 31 on sub-atmospheric pressure equilibrium curve 32 is expressed as $\Delta$ E, the distance between point 45 and curve 32 in the direction of the free oxygen coordinate is expressed as $\Delta$O, and the distance between point 45 and curve 32 in the direction of the carbon coordinate is expressed as$\Delta$C. In other words, $\Delta$O is the distance between point 45 on trajectory 33 and point 46 on equilibrium curve 32. Similarly $\Delta$C is the distance between point 45 on trajectory 33 and point 47 on equilibrium curve 32. Coefficient Alpha may be expressed alternatively as follows:

$$\text{Alpha} = f_1(\Delta E)$$
$$\text{Alpha} = f_2(\Delta C)$$
$$\text{Alpha} = f_3)\Delta O)$$

Assuming the $\Delta$O value is used, Alpha can be defined by the following formula:

$$\text{Alpha} = a_1 \times \Delta O + a_2(a_3 \times \Delta O + a_4)$$

In the foregoing formula, constants $a_1$ through $a_4$ are determined empirically and, in general, will differ for different RH vacuum degassing installations. Generally, in orders of magnitude, constant $a_1 = 10^{-5}$ and is expressed as [1/ppm×sec.]; constant $a_2 = 10^{-2}$ and is expressed as [1/sec.]; constant $a_3 = 10^{-4}$ and is expressed as [1/ppm]; and constant $a_4 = 10^{-1}$ and is expressed numerically only. O is expressed as ppm (parts per million).

$$dO = D \times \text{Beta}\ (O_{eq.} - O) \times dt - 1.33 \times dC - dO\ (\text{deoxidants}) \qquad \text{Equation (2)}$$

In equation 2, D is the rate of oxygen return from the slag, expressed as [1/sec.] and=0.0075.

Beta is the coefficient of the vacuum (partial pressure) effect on oxygen return from the slag. Beta is defined as:

Beta=$b_1 + b_2 \times$partial pressure of CO at a given point in the treatment.

The constants $b_1$ and $b_2$ are determined empirically for a given installation. Generally, in orders of magnitude, $b_1 = 10^{-1}$ and is expressed numerically, only, and $b_2 = 10^{-3}$ and is expressed as [1/Torr.]. The partial pressure of CO is expressed as Torr.

Oeq. is the dissolved oxygen equilibrium in the slag and is a function of the temperature. Oeq. is obtained from a handbook and reflects the equilibrium reaction between Fe and dissolved O in the slag: $Fe+O \rightleftharpoons FeO$ Oeq. is expressed as follows:

$$Oeq.=10^{n}/1000, \text{ where } n=2.734-6329/T$$

Oeq. is expressed as ppm, and T is expressed as K°. 0, in that part of equation 2 expressed as "(Oeq.−0)", is the dissolved oxygen content, in ppm, at a given time in the treatment.

dO (deoxidants) is the decrease in dissolved oxygen content due to the addition of deoxidants (e.g. manganese addition). For simplification purposes, the deoxidant addition time is assumed to be negligible compared to the total treatment time, and dO (deoxidants) can be assumed to be ΔO (deoxidants). ΔO (deoxidants) can be readily calculated for each deoxidant added, from the known amount of deoxidant added and the known stoichiometry of the particular oxidizing reaction.

$$dT=Gamma\times(T\ steel-T\ vessel)\times dt\ -dT\ (cooling)+dT\ (heating). \qquad \text{Equation (3)}$$

In equation 3, Gamma is the coefficient of heat loss and is defined as follows:

$$Gamma=c_1\times exp.\ (-c_2\times t)+c_3.$$

The constants $c_1$ through $c_3$ are determined empirically and, in general, will differ for different RH vacuum degassing installations. Generally, in orders of magnitude, $c_1=10^{-3}$, $c_2=10^{-3}$, and $c_3=10^{-1}$. All three constants are expressed as [1/sec.]. In the definition of Gamma, t is the treatment time expressed in seconds.

In equation 3, dT (cooling) and dT (heating) respectively refer to the cooling effect of alloy or other solid additions and to the heating effect of exothermic reactions. For simplification purposes, both of these dT's are assumed to occur instantaneously so that dT (cooling) =ΔT (decrease) and dT (heating)=ΔT (increase), both expressed as K°. Both ΔT's can be readily determined empirically from known or measurable data for a given alloying addition or a given Al-oxygen blowing reheating procedure.

In equation 3, T vessel and T steel refer to the respective vessel and molten steel temperatures at a given time in the treatment, expressed as K°. Equation 3 accounts for both the intrinsic temperature drop and the effect on temperature of extraneous factors which can occur during the process.

In summary, the three differential equations discussed above as one example for mathematically approximating real trajectory 43 are as follows:

$$dC=-C\times Alpha\times dT+dC\ (alloys) \qquad (1)$$

$$dO=D\times Beta\ (Oeq.-O)\times dT-1.33\ \times dC-dO\ (deoxidants) \qquad (2)$$

$$dT=Gamma\times(T\ steel-T\ vessel)\ x\ dt\ -dT\ (cooling)+dT\ (heating). \qquad (3)$$

Equation 3, of course, does not participate in the two-dimensional display of real trajectory 43 in FIG. 2 but would be incorporated into a three dimensional display on a graph having three coordinates (such as FIG. 4).

The equations set forth above define a model consisting of three non-linear differential equations of the first order. These equations cannot be solved independently from one another. Instead all three equations are simultaneously solved numerically. The solution starts from the initial point of t=0, C=C(initial), 0=0(initial) and T=T(initial) and continues up to the point of the intersection of (a) the trajectory defined by these equations (the 3-dimensional counterpart of trajectory 43 in FIG. 2) with (b) the lower equilibrium curve for the subatmospheric pressure at which the treatment is to be conducted (curved surface 132 in FIG. 4).

If as shown in FIG. 2, the end point 41 of real trajectory 43 does not coincide with the aim end point 31 of theoretical idealized trajectory 33, an adjustment must be made from the starting point 35 on the atmospheric pressure equilibrium curve 34, e.g. to point 42 thereon. The adjustment shown in FIG. 2 has a starting point 42 with a lower carbon content and a higher dissolved oxygen content than theoretical starting point 35, to compensate for the fact that end point 41 on real trajectory 43 has a higher carbon content and a lower dissolved oxygen content than the end point 31 on theoretical idealized trajectory 33. The actual trajectory when the starting point is at 42 is then calculated, using the same three differential equations described above, and the resulting adjusted idealized trajectory, ending at aim point 31, is indicated at 44. It may be necessary to make more than one adjustment of the starting point on atmospheric pressure equilibrium curve 34 to end up with a finish point corresponding to aim point 31 on subatmospheric pressure equilibrium curve 32. However, one should be able to determine an idealized starting point with one or two adjustments.

After the adjusted idealized trajectory 44 has been determined, one follows the remaining steps of the procedure described above with respect to a theoretical idealized trajectory. The limits for the carbon content are determined just as they were for theoretical idealized trajectory 33, and these in turn determine the limits for the dissolved oxygen content. The maximum and minimum permissible limits for carbon and dissolved oxygen for adjusted idealized trajectory 44 are shown at 44' and 44" in FIG. 3. In FIG. 3, part of the adjusted idealized trajectory is shown as coinciding with a theoretical idealized trajectory 33, although this need not be so and probably won't be so after carbon and dissolved oxygen limits have been associated with the adjusted idealized trajectory. Temperature limits are applied to the adjusted idealized trajectory in the same manner as with the theoretical idealized trajectory, as shown in FIG. 4. Although a graphic display, showing the resulting three dimensional adjusted idealized trajectory with temperature limits applied thereto, is not shown in the drawings, it would conform to trajectory 44, with limits 44' and 44" (FIG. 3), extended along a temperature coordinate, within the prescribed temperature limits as in FIG. 4. In addition, the trajectory would be skewed, generally, in the direction of increasing temperature from the end to the beginning of the trajectory; and there would be other changes along the temperature coordinate to reflect the change in temperature due to extraneous factors such as alloy additions or exothermic reactions, both of these factors producing abrupt changes along the temperature coordinate.

The boundaries for the adjusted idealized trajectory can be calculated employing the same set of equations as are employed to determine trajectory 44.

The remaining steps in the control procedure associated with the treatment are the same for the adjusted idealized trajectory as for the theoretical idealized trajectory. The initial carbon, dissolved oxygen, and temperature values for the steel received from the basic oxygen furnace are measured, and adjustments are made to bring these values within the boundaries of the adjusted idealized trajectory at the trajectory's upper end boundary defined by the atmospheric pressure equilibrium curve (surface 134 in FIG. 4). As the treatment progresses, the temperature and dissolved oxygen content are measured, and the carbon content is determined. The point defined by these three parameters is located on a three dimensional plot, similar to FIG. 4, and if that point is found to be outside the boundaries of the adjusted idealized trajectory, adjustments are made, in the manner described above in connection with the theoretical idealized trajectory, to bring all three parameters within the boundaries of the adjusted idealized trajectory.

A treatment in accordance with the practices employed in the present invention has substantial advantages over a treatment employing conventional practices. In a RH–OB installation, conventional practices, similar to those described above in the section entitled "Background of the Invention", were replaced by practices in accordance with the present invention. The result was a substantial decrease in the relative error between (a) the actual carbon and dissolved oxygen contents obtained at the end of the treatment and (b) the predicted or aim values for those parameters. The extent of this improvement is tabulated below.

| | Carbon | | Dissolved Oxygen | |
|---|---|---|---|---|
| | Conventional Practice | Present Invention | Conventional Practice | Present Invention |
| Average Relative Error (%) | −3.44 | −0.59 | 27.97 | −1.29 |
| Standard Deviation of the Relative Error (%) | 28.6 | 9.20 | 35.22 | 11.73 |
| Sample Size | 35 | 35 | 45 | 45 |

The average error for end temperature, with the present invention, was 0.5° C. and the standard deviation was 3.5° C., where the aim end temperature was about 1580° C.

As noted above, reducing the error between predicted values and actual values is beneficial because it reduces post treatment correctional practices, which are undesirable.

In examples of an RH—OB process conducted in accordance with the present invention, the heat size is typically 220–230 tonnes. The molten steel from the basic oxygen furnace has a carbon content typically in the range 0.05–0.07 wt. % and a dissolved oxygen content typically in the range 300–500 ppm. At the end of the treatment, the carbon content is typically in the range 0.002–0.04 wt. % and the dissolved oxygen content, before final aluminum deoxidation, is typically about 80 ppm or higher. The sub-atmospheric pressure is typically in the range of about 0.5–200 Torr. The treatment time is typically in the range 10–32 min. The temperature during the treatment is typically in the range 1605°–1615° C. at the beginning of the process (after pre-treatment) and in the range 1575°–1585° C. at the end of the process, where the solidus temperature is about 1530° C., for example. Generally, the temperature permissibly can be about 45°–65° C. above the solidus temperature at the end of the process and an additional 20°–40° C. higher at the beginning of the process. Final carbon contents at the lower end of the range usually require forced decarburization and/or lower treatment pressures and longer treatment times.

The foregoing detailed description has been given for clearness of understanding only, and no unnecessary limitations should be understood therefrom, as modifications will be obvious to those skilled in the art. For example, a process in accordance with the present invention need not be restricted to RH or RH—OB vessels but may be employed with other types of vessels, so long as the bath undergoes the desired circulation under reduced pressure.

We claim:

1. In a process wherein a vertically circulating bath of molten steel containing dissolved oxygen and carbon is subjected to a preselected sub-atmospheric pressure to reduce the dissolved oxygen and carbon contents of said molten steel, the steps comprising:

defining, on a three-coordinate plot, the boundaries for the idealized trajectory to be followed by said dissolved oxygen and carbon contents when those contents decrease with a decrease in pressure between atmospheric pressure and the preselected sub-atmospheric pressure;

said three dimensional plot being characterized by having carbon content along a first coordinate, dissolved oxygen content along a second coordinate and temperature along a third coordinate;

the (a) upper and (b) lower end boundaries for said idealized trajectory being defined by the carbon-/oxygen equilibrium curves, for a preselected temperature, at (a) atmospheric pressure and (b) said preselected sub-atmospheric pressure, respectively;

the temperature boundaries for said idealized trajectory being determined by the permissible range of said preselected temperature, said preselected temperature being based on the desired casting temperature for said molten steel;

initially reducing the pressure to which said molten steel is subjected, by an amount not substantially greater than that required to initiate vertical circulation;

making measurements of the dissolved oxygen and carbon contents and of the temperature of said molten steel no later than said initial pressure reducing step;

locating, on said three-coordinate plot, the point defined by said three measurements and determining whether said point falls within the upper end boundary of said idealized trajectory;

making whatever adjustment is necessary of at least one of dissolved oxygen and carbon contents and temperature, to bring all of them within the boundaries of said trajectory at substantially said upper end boundary, in a pre-treatment step performed at a pressure no less than said initially reduced pressure;

after said pre-treatment step, further reducing the pressure to which said molten steel is subjected, until the pressure reaches said preselected sub-atmospheric pressure;

periodically monitoring at least the dissolved oxygen content and temperature after said vertically circulating bath of molten steel has been subjected to a further reduced pressure;

determining the carbon content corresponding to the dissolved oxygen content and temperature for each instance of said periodic monitoring;

locating, on said three-coordinate plot, for each instance of said periodic monitoring, the point defined by the corresponding dissolved oxygen content, carbon content and said temperature, and determining whether said point falls within the boundaries of said idealized trajectory;

then, for each instance of periodic monitoring, making whatever adjustment is necessary of at least one of said dissolved oxygen and carbon contents and temperature to bring all of them substantially within the boundaries of said idealized trajectory, as said process continues.

2. In a process as recited in claim 1 and comprising:

continuing said process until the carbon content has been reduced to a level within said lower end boundary;

and then adding an amount of solid, non-carbonaceous deoxidizing agent sufficient to reduce the remaining dissolved oxygen content to the level desired, by forming an oxide of said deoxidizing agent.

3. In a process as recited in claim 2 wherein said molten steel is covered by a slag layer during said process, and said process comprises:

confining the addition of other amounts of solid, non-carbonaceous deoxidizing agent to a time in said process sufficiently early to flush the resulting oxide into said slag layer by the time the process has concluded.

4. In a process as recited in claim 1 wherein said first recited adjustment-making step comprises:

aiming for a point within the boundaries of said idealized trajectory further down said trajectory than said upper end boundary.

5. In a process as recited in claim 1 wherein said second recited adjustment-making step comprises:

aiming for a point, within the boundaries of said idealized trajectory, at the intersection, with said idealized trajectory, of a plane which contains said defined point and which is perpendicular to said idealized trajectory.

6. In a process as recited in claim 1 wherein said second recited adjustment-making step comprises:

aiming for a point, within the boundaries of said idealized trajectory, further down said idealized trajectory than the intersection, with said idealized trajectory, of a plane which contains said defined point and which is perpendicular to said idealized trajectory.

7. In a process as recited in claim 1 wherein:

said preselected temperature is in the range of about 45°–65° C. above the solidus of said molten steel at said lower end boundary of said idealized trajectory.

8. In a process as recited in claim 1 wherein:

the boundaries of (a) the carbon content and (b) the dissolved oxygen content on said idealized trajectory are determined by (a) the permissible range of carbon content in the end product resulting from said process and (b) the range of dissolved oxygen content, corresponding to said permissible range of carbon content, on said carbon/oxygen equilibrium curve for said preselected sub-atmospheric pressure.

9. In a process as recited in claim 1 wherein said molten steel is covered by a slag layer during said process, and said idealized trajectory is determined by a procedure comprising:

determining the theoretical idealized trajectory for said process;

and then adjusting said theoretical idealized trajectory to reflect the effect on said carbon and dissolved oxygen contents, during said process, of at least (a) carbon-containing, solid ingredient additions and (b) dissolved oxygen return to said molten steel from said slag layer.

10. In a process as recited in claim 9 wherein said step of determining said theoretical idealized trajectory comprises:

selecting the carbon aim point on said first coordinate;

determining the point, on said carbon/oxygen equilibrium curve for said preselected sub-atmospheric pressure, corresponding to said aim carbon content;

and then projecting a line at a slope of 1.33 from (a) said point on said sub-atmospheric pressure equilibrium curve to (b) the intersection of said line with said carbon-oxygen equilibrium curve for atmospheric pressure;

said line essentially defining said theoretical idealized trajectory.

11. In a process as recited in claim 9 wherein said process is performed in a vessel and said adjusting of said theoretical idealized trajectory reflects:

changes in the temperature of said molten steel during said process due to (a) solid ingredient additions, (b) exothermic reactions and (c) the difference in temperature between said molten steel and said vessel in which said process is performed.

12. In a process as recited in claim 11 wherein:

said preselected temperature is in the range of about 45°–65° C. above the solidus of said molten steel at said lower end boundary of said idealized trajectory and an additional 20°–40° C. higher at said upper end boundary of the idealized trajectory.

13. In a process as recited in claim 9 wherein said process is performed in a vessel and said adjusting of said theoretical idealized trajectory reflects:

the effect of said sub-atmospheric pressure on said dissolved oxygen return from the slag;

the effect on dissolved oxygen content of solid ingredient additions which react with dissolved oxygen.

14. In a process as recited in claim 9 wherein said process is performed in a vessel and said adjusting of said theoretical idealized trajectory reflects:

the effect of a change, during said process, in one of the three parameters comprising carbon content, dissolved oxygen content and temperature, on the other parameters.

* * * * *

UNITED STATES PATENT AND TRADEMARK OFFICE

CERTIFICATE OF CORRECTION

PATENT NO. : 4,810,286

DATED : March 7, 1989

INVENTOR(S) : Schlichting, et al.

It is certified that error appears in the above-identified patent and that said Letters Patent is hereby corrected as shown below:

Col. 5, line 21, change "veew" to --view--;

Col. 7, line 13, change zero to letter "O";
line 17, change zero to letter "O";

Col. 13, line 51, change "temeerature" to --temperature--;
line 67, change "t" to "f";

Col. 15, line 9, change zero to letter "O";
line 10, change zero to letter "O";

Col. 16, line 4, change zeroes in "0=0(initial)" to letter "O"'s.

Signed and Sealed this

Twenty-sixth Day of September, 1989

*Attest:*

*Attesting Officer*

DONALD J. QUIGG

*Commissioner of Patents and Trademarks*